United States Patent [19]

Goransson

[11] 4,148,490

[45] Apr. 10, 1979

[54] MINIATURE GOLF COURSE INCLUDING PIVOTABLE OBSTACLE

[76] Inventor: Jan Goransson, Ekliden 20, Orkelljunga, Sweden, 286 00

[21] Appl. No.: 798,944

[22] Filed: May 17, 1977

[30] Foreign Application Priority Data

May 20, 1976 [SE] Sweden ..... 7605715

[51] Int. Cl.[2] ..... A63B 69/36

[52] U.S. Cl. ..... 273/176 B; 273/181 A

[58] Field of Search ..... 273/176 E, 176 B, 87 C, 273/177 R, 87.2, 176 F, 176 FA, 176 FB, 176 G, 181 A; 16/153, 154

[56] References Cited

U.S. PATENT DOCUMENTS

| | | | |
|---|---|---|---|
| 725,433 | 4/1903 | Flippen | 16/154 |
| 1,052,928 | 2/1913 | Vergne et al. | 16/153 |
| 1,822,244 | 9/1931 | Smith | 273/176 B X |
| 2,827,299 | 3/1958 | Dean | 273/87.2 X |
| 2,894,749 | 7/1959 | Rook | 273/176 E |

*Primary Examiner*—George J. Marlo

*Attorney, Agent, or Firm*—William F. Frank

[57] ABSTRACT

An obstacle device for mini-golf courses comprises at least one movable obstacle which is mounted on one of a plurality of course sections adapted to be connected to each other. The obstacle device has an elongated supporting element which carries at least one obstacle member pivotable about a vertical shaft so that it may be moved from a position in which it blocks a portion of the course into a position where it is recessed in a cavity provided in a post of the course at a higher level and does not block the course.

6 Claims, 3 Drawing Figures

MINIATURE GOLF COURSE INCLUDING PIVOTABLE OBSTACLE

The present invention relates to an obstacle device for mini-golf courses having at least one movable obstacle preferably mounted on one of a number of course sections which are adapted to be connected to each other.

Obstacle devices of the above mentioned construction are already known in various forms. However, the movable obstacles are mostly of such a type that they cannot be easily disassembled or otherwise arranged in such a way that, when so desired, they do not interfere with the game.

Accordingly it is an object of the present invention to eliminate the above mentioned drawback and to provide an obstacle device comprising movable obstacles which can be moved out of a position which could interfere with the game without requiring its disassembly.

For that purpose the obstacle device according to the invention is characterized in that it comprises an elongated supporting element having at least one obstacle member and by pivoting about a vertical shaft which is adjustable from a position in which the obstacle member blocks a portion of the course, into a position in which the at least one obstacle member is recessed in a cavity located at a higher level than the course in a post of the course.

The above mentioned feature as well as other features and advantages of the invention will be more clearly described in the following specification with reference to the accompanying drawing, in which.

Figure 1:
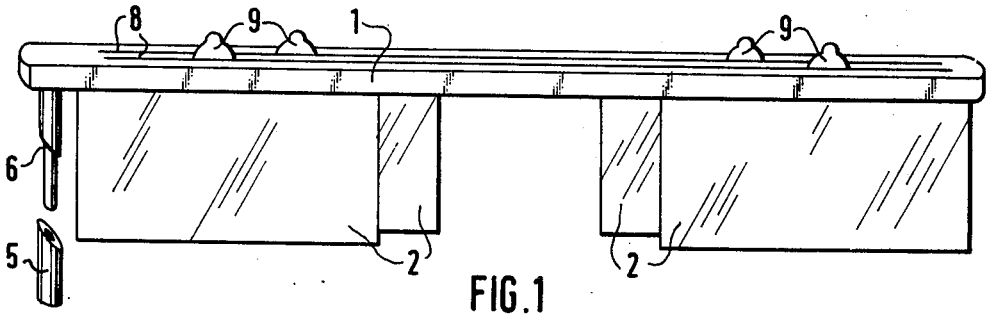
FIG. 1 is a perspective view of an obstacle device according to the invention.
Figure 2:
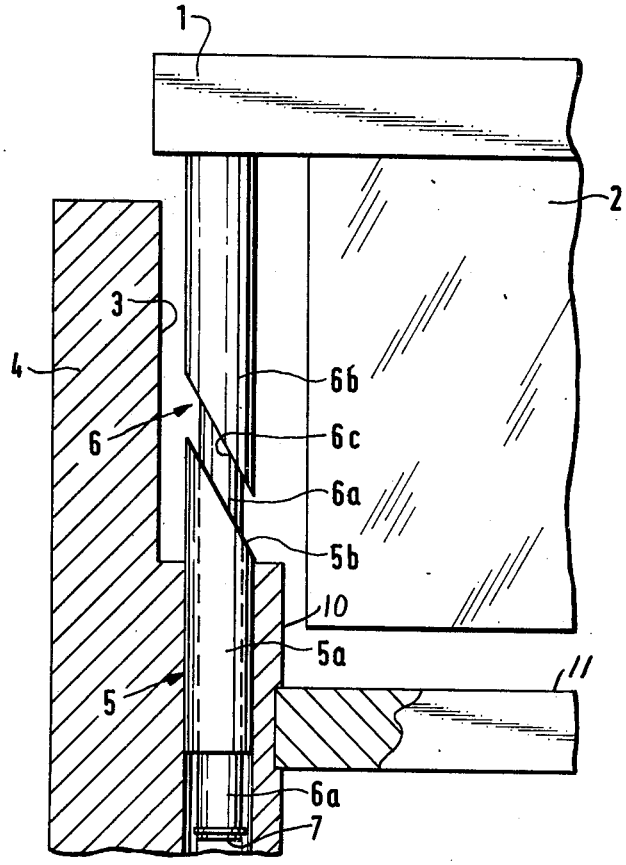
FIG. 2 is an enlarged view of a portion of the obstacle device according to FIG. 1 and shows the mounting of the device in a post of the course.

As appears particularly from FIG. 1, the obstacle device according to the invention comprises an elongated supporting element 1 having at least one obstacle member 2, in the illustrated embodiment four members consisting of a square, preferably rectangular plate. The obstacle device is intended to be mounted on one of a number of course sections (not shown) which are adapted to be connected to each other so as to form a playing surface of a desired length for a mini-golf course, each sectin having a rim along its length, and the obstacle device according to the invention is arranged in such a way that the supporting element 1, by pivoting about a vertical pivot shaft, is adjustable from a position in which the obstacle members 2 block a portion of the playing surface of the course, into a position in which the obstacle members 2 are recessed in a cavity 3, located at a higher level than playing surface 11 of the course, in a post 4 of the rim 10 of the playing surface 11 of the course (see FIG. 2). Thus, in the recessed position no part of the obstacle device will be within the course defined by the post 4 and rim 10, and in that position the device does not have any projecting parts which could detrimentally interfere with the play on the playing surface 11 of the course.

The shaft about which the obstacle is pivotable is formed partly by a bearing member 5 mounted in the rim 10 and partly by a holder 6 cooperating with the bearing member 5 and mounted on the supporting element 1. The bearing member 5 in the rim 10 consists of a socket forming member 5*a* extending upwardly into the cavity 3 and having an oblique top surface 5*b*. The holder 6 consists of a pin 6*a* extending downwardly from the supporting element 1 and rotatably engages the socket forming member 5*a*. The pin 6*a* is provided with an enlarged top portion 6*b* having an oblique bottom surface 6*c* cooperating with the oblique top surface 5*b* of the socket forming member 5*a*. The cooperation of the oblique operative surfaces 5*b*, 6*c* permits the obstacle to be raised when it is pivoted towards the post 4, such that the obstacle members 2 will move into the cavity 3 when they reach the post 4. This embodiment is particularly advantageous because the cavity 3 does not interfere with the play on the course.

In order to provide a reliable retention of the obstacle on the course and to prevent the pin 6*a* from being pulled upwardly out of the socket forming member 5*a* by mistake the pin 6*a* at the bottom end thereof below the socket forming member 5*a* is provided with a locking member 7 which cooperates with the bottom end of the socket forming member 5*a*. The locking member preferably consists of a locking washer 7 which is inserted into a peripheral groove in the pin 6*a*, and in order to permit a rapid and simple mounting or dismounting of the obstacle, the locking washer 7 may be applied to the pin 6*a*, for instance through an aperture (not shown) in the post 4 or in another suitable way. However, the pin 6*a* and the socket forming member 5*a* must have such a shape that the locking washer 7 permits the obstacle members 2 to be pivoted away into the cavity 3 in the post 4, as described above, before the locking washer 7 engages the bottom end of the socket forming member 5*a*.

Figure 3:
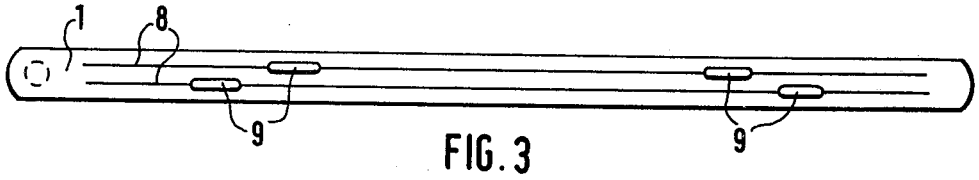
FIG. 3 is a top view of the obstacle device according to FIG. 1.

The supporting element 1 is provided with at least one longitudinal slot 8 (see FIG. 3), and on the top of the supporting element 1 is located at least one operating member 9 which is guided in the slot 8 and connected to at least one of the obstacle members 2 which therefore can be moved along the supporting elment 1 by means of the operating member 9. In the illustrated embodiment with four obstacle members 2 the supporting element 1 has two parallel slots 8, and in each slot 8 are guided two operating members 9, one for each of the obstacle members 2. However, the number of obstacle members 2 may vary as may the number of slots 8 and also the number of operating members 9.

It is obvious that modifications and alterations of the present invention besides those described above are possible within the scope of the following claims without departing from the concept and purpose of the invention.

What is claimed is:

1. In a mini-golf course comprising a plurality of a number of course sections which are adapted to be connected to each other so as to form a playing surface of a desired length, an obstacle device for said playing surface, said obstacle device being movably positioned on at least one of said sections, each section having a rim for defining the edge of the playing surface of the section, the obstacle device comprising an elongate support member having at least one obstacle member mounted thereon for movement longitudinally thereof and a vertical pivot axle mounted in said rim about which axle the support member is pivotal, with respect to the rim, between a position in which the support member projects away from the rim across the playing surface so that at least one obstacle member can be disposed to obstruct a portion of the playing surface, and a position in which the support member is moved into a position relative to the rim so that said at least one obstacle member can be moved into a cavity formed by a post on the rim, the cavity being disposed relative to said rim so as to require the support member to be raised before the at least one obstacle member can be moved into the cavity.

2. A device according to claim 1 wherein the vertical pivot axle comprises a bearing member provided on the rim and cooperating with a holder on the support member, said bearing member and said holder having opposing oblique operative surfaces engaging each other to cause the support member to be raised when it is pivoted toward the rim.

3. A device according to claim 2 wherein the bearing member consists of a socket forming member mounted in the rim and extended upwardly above said rim and having an oblique top end surface, and said holder comprises a pin extending downwardly from said support member and engaging said socket forming member, the said pin having an enlarged top portion engaging the support member, the bottom end surface of said top portion having an oblique surface matching, and cooperating with, the oblique end surface of the socket forming member.

4. The device according to claim 1 wherein the support member has at least one longitudinal slot therein, the longitudinal slot carrying therein at least one operating member from which depends said obstacle member, such that said obstacle member is movable along said slot.

5. A device according to claim 4 wherein the support member is provided with at least two parallel longitudinal slots, there being at least one operating member movable in each slot, said at least one operating member having an obstacle member depending therefrom.

6. The device according to claim 5 wherein each obstacle member consists of a rectilinear panel.

* * * * *